US005125247A

United States Patent [19]

Mills

[11] Patent Number: 5,125,247

[45] Date of Patent: Jun. 30, 1992

[54] WASHING MACHINE OVERFLOW PREVENTION DEVICE SIGNAL QUALITY INDICATOR

[76] Inventor: Stephen D. Mills, 144 Clark Rd., Snow Camp, N.C. 27349

[21] Appl. No.: 636,501

[22] Filed: Dec. 31, 1990

[51] Int. Cl.[5] ..... D06F 37/42

[52] U.S. Cl. ..... 68/208; 137/312; 340/624

[58] Field of Search ..... 18/208; 134/155, 56 R, 134/186, 57 D, 57 R, 580, 58 R; 137/312; 200/84 R, 84 C; 340/624

[56] References Cited

U.S. PATENT DOCUMENTS

| | | | |
|---|---|---|---|
| 2,905,783 | 9/1959 | Johnson, Jr. | 200/84 R |
| 3,185,789 | 5/1965 | Guntner | 340/624 X |
| 3,774,187 | 11/1973 | Windham | 340/624 X |
| 4,069,837 | 1/1978 | Jirasek | 68/208 X |
| 4,080,985 | 3/1978 | Eagle | 340/624 X |
| 4,305,420 | 12/1981 | Nussdorf | 200/84 R |
| 4,380,243 | 4/1983 | Braley | 137/312 |
| 4,392,128 | 7/1983 | Young et al. | 340/616 |
| 4,418,712 | 12/1983 | Braley | 137/312 |
| 4,796,658 | 1/1989 | Caple | 137/312 |
| 4,955,213 | 9/1990 | Ohsugi et al. | 68/12 R |
| 4,962,370 | 10/1990 | Borriello | 340/623 |
| 5,026,954 | 6/1991 | Cebulski | 340/624 X |
| 5,028,910 | 7/1991 | Meacham | 340/624 X |

*Primary Examiner*—Frankie L. Stinson

*Attorney, Agent, or Firm*—Richard E. Jenkins

[57] ABSTRACT

A washing machine overflow prevention device for use with an automatic washing machine and a conventional fixed drain conduit. The device includes a float switch adapted to be removably positioned below the drain hose of the washing machine within the drain conduit and to be actuated from a normally open to a closed mode when the water level backs up to a predetermined level in the drain conduit. The float switch comprises an elongated protective cover thereover defining a first closed end positioned proximal to the top of the drain conduit and a second open end positioned distally to the top of the drain conduit to protect the float switch from waste water flowing thereover from the washing machine drain hose. Circuit means are electrically connected to the float switch and interposed between the washing machine and an electrical outlet for interrupting electrical power to the washing machine upon actuation of the float switch from the normally open to the closed mode when waste water backs up within the drain conduit due to a blockage therein.

7 Claims, 4 Drawing Sheets

WASHING MACHINE OVERFLOW PREVENTION DEVICE SIGNAL QUALITY INDICATOR

DESCRIPTION

1. Technical Field

The present invention relates to prevention devices, and more particularly to an overflow prevention device for shutting-off a washing machine appliance when the drain line is clogged.

2. Related Art

A well known problem associated with modern automatic washing machines is the periodic waste water overflow which occurs when the drain line becomes clogged. Since the user of the automatic washing machine may not be in the vicinity of the machine when the drain tube becomes clogged, the back-up of waste water being pumped from the washing machine during the automatic washing cycle can result in a substantial amount of spillage of water on the surrounding floor area. The inconvenience associated with mopping up the water spillage is well known to all users of automatic washing machines. In an effort to overcome this well known problem associated with washing machines, many efforts have been made to develop an overflow prevention system which will automatically stop the washing machine when water begins to back up in the drain tube. Unfortunately, applicant is not aware of any simple and truly effective system to address this problem, and thus the search goes on for a simple and reliable device to eliminate this long-standing problem associated with modern day automatic washing machines.

Representative of previous efforts to solve this problem is U.S. Pat. No. 4,380,243 to Braley which discloses an electro-mechanical overflow control system for use with home appliances such as washing machines. The primary embodiment of the invention disclosed in the patent utilizes an elaborate vertical standpipe which must be inserted into the existing drain conduit and the washing machine drain hose then placed into the top thereof. The standpipe appears to be of a substantial length (about 10 to 20 inches) and includes a weighted rod connected to a push-to-open switch at the top of the standpipe. Upon the raising of the water level in the standpipe, the rod will serve to trip the switch and actuate an electrical interrupt circuit into which the washing machine is plugged. This overflow control system possesses a number of shortcomings including both its obtrusive size and complexity as well as the requirement that the water level back up to the top of the standpipe before the trip switch is actuated. This clearly provides the potential for some minor water spillage around the automatic washing machine immediately prior to electrical disconnection by the overflow control system. Also, and very importantly, most drain conduits in modern homes are positioned within a recessed receptacle plate in the laundry room and would not lend themselves to attachment of the large vertical standpipe device required by the overflow control system of the Braley patent.

These and other shortcomings of the prior art have been overcome by the overflow prevention device of applicant's invention which offers a particularly effective solution to the problem of water spillage associated with automatic washing machines when the drain line becomes clogged.

DISCLOSURE OF THE INVENTION

In accordance with the present invention, applicant provides an automatic washing machine overflow prevention device designed specifically to prevent any water spillage resulting from water back up when the drain line becomes clogged. The device comprises a magnetic float switch which is removably positioned below the drain hose within the top portion of the drain conduit and adapted to be actuated from a normally open to a closed mode when the water level backs up to a predetermined level in the top portion of the drain conduit. The magnetic float switch includes an elongated protective cover thereover defining a first closed end positioned proximal to the top of the drain conduit and a second open end positioned distally to the top of the drain conduit for receiving water therein when the water level rises due to the drain line becoming clogged. Circuit means are electrically connected to the magnetic float switch and interposed between the automatic washing machine and the electrical outlet therefor for interrupting electrical power flow to the washing machine upon actuation of the magnetic float switch from the normally open to the closed mode. Applicant further contemplates that a suitable attachment means will be provided for removably securing the magnetic float switch at a predetermined location within the top portion of the drain conduit.

Accordingly, it is the object of the present invention to provide an automatic washing machine overflow prevention device which is simple and reliable to disconnect the power to the washing machine when the drain conduit becomes clogged and prior to any waste water spillage.

It is another object of the present invention to provide a washing machine overflow prevention device which can be used with any automated washing machine and waste water drain conduit associated therewith, particularly drain conduits positioned within recessed plates such as commonly found in the laundry rooms of modern homes.

It is still another object of the present invention to provide a washing machine overflow prevention device utilizing a magnetic float switch contained within a protective cover so as to permit reliable actuation thereof by the rising water level in a clogged drain conduit even while waste water flows thereover from the washing machine drain hose positioned thereabove in the drain conduit.

Some of the objects of the invention having been stated, other objects will become evident as the description proceeds, when taken in connection with the accompanying drawings as described below.

BEST MODE FOR CARRYING OUT THE INVENTION

Figure 1:
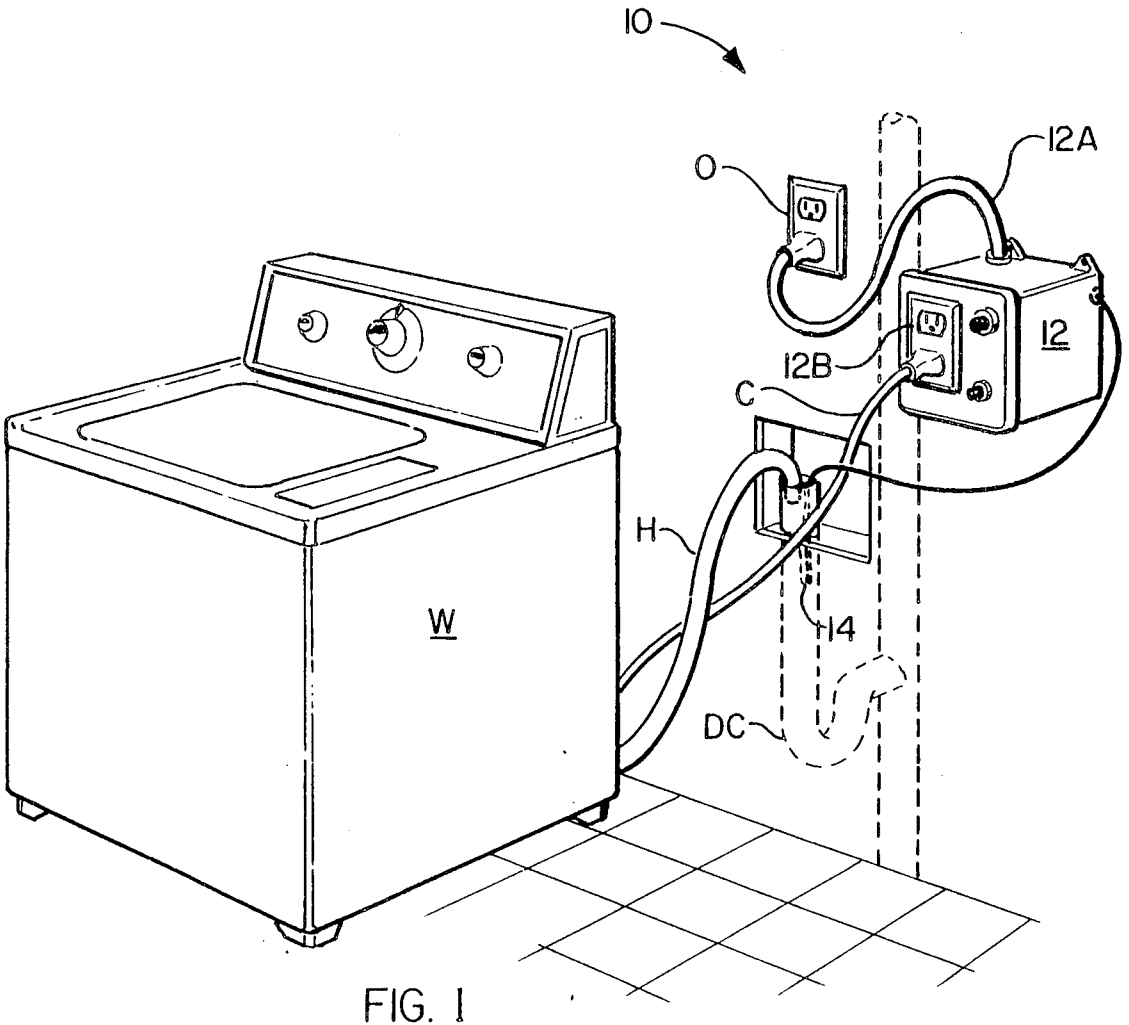
FIG. 1 is a perspective view of a washing machine provided with the overflow prevention device.

Referring now more specifically to the drawings, FIG. 1 shows an automatic washing machine W with a conventional electrical cord C. Normally, electrical cord C would be plugged into electrical outlet O located in the wall behind washing machine W. Also, washing machine W is provided with waste water drain hose H which is inserted into a fixed waste water drain conduit typically positioned immediately behind washing machine W. Although FIG. 1 depicts the drain conduit as extending outwardly from the wall or partition behind washing machine W, it will be appreciated by those familiar with modern plumbing that the waste water drain conduit DC in most modern residential laundry rooms is positioned in a recessed plate which also contains outlets for providing hot and cold water to the washing machine (not shown). It will also be appreciated that all of the description heretofore is for conventional electrical power and waste water drain connections for automated washing machine W.

As is also well known to those who use modern automated washing machines, blockage of the waste water drain conduit DC can occur due to the large amount of lint and other debris in the waste water which is pumped from washing machine W. Therefore, it is not uncommon that a total obstruction will periodically occur in the waste water drain conduit or in the sewage line downstream therefrom which will in turn cause the waste water to back up waste water drain conduit DC and overflow therefrom. The resulting water spillage from the waste water back-up can be very substantial to the floor and wall area around washing machine W. A great deal of effort is required to mop up the spilled waste water and many times the water spillage may damage adjacent carpeting, hardwood floors, or other areas of a residence.

With reference now to FIGS. 1–4, applicant's washing machine overflow prevention device, generally designated 10, will be described in detail. With particular reference again to FIG. 1, overflow protection device 10 can be seen to comprise an enclosure 12 which comprises an electrical cord and plug 12A which is plugged into electrical outlet O and an electrical outlet 12B into which the electrical cord C of washing machine W is plugged. An electrical circuit is provided within enclosure 12, and will be described in more detail below, which serves to interrupt the electrical power flow from electrical outlet O to automatic washing machine W when magnetic float switch 14 electrically connected thereto and positioned in drain conduit DC is caused to close by waste water backing up thereto.

Figure 2:
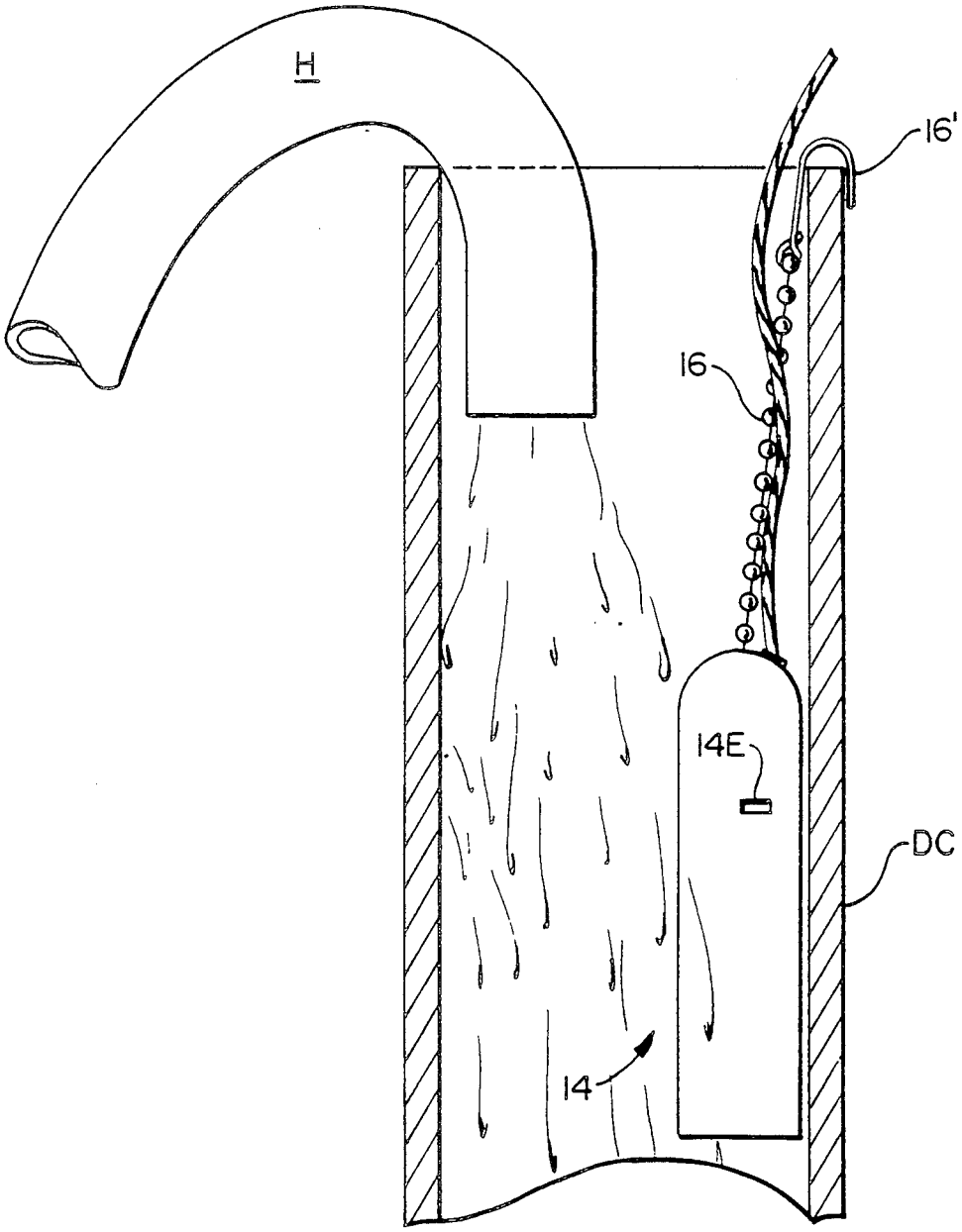
FIG. 2 is an enlarged view of the float switch of the overflow prevention device as positioned in the upper portion of a drain conduit.

As can be fully appreciated with reference to FIGS. 1 and 2, magnetic float switch 14 is positioned in waste water drain conduit DC below drain hose H a sufficient distance to provide a relatively early detection of a clogged condition in drain conduit DC and the backing up of waste water therein. This assures that overflow prevention device 10 will electrically disconnect washing machine W early enough to prevent even a minor waste water spillage from drain conduit DC. As best seen in FIG. 2, applicant contemplates that magnetic float switch 14 may be secured at a predetermined location in drain conduit DC by means of a flexible chain 16 which is attached at one end to float switch 14 and at the other end to a hook 16' which is secured to the top outer rim of waste water drain conduit DC.

Figure 3B:
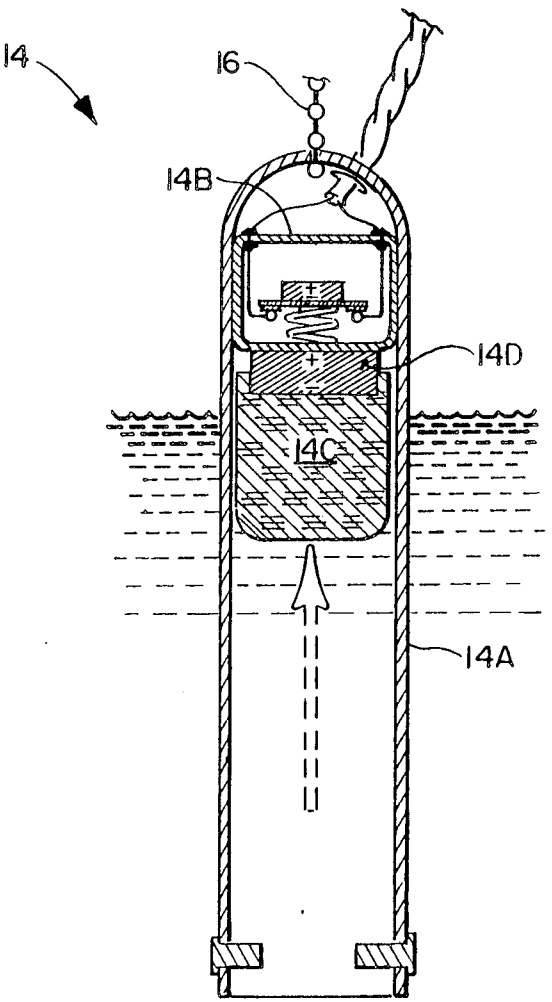
FIGS. 3A and 3B are vertical sectional views of the float switch of the overflow prevention device in the open and closed circuit mode, respectively.
Figure 3A:
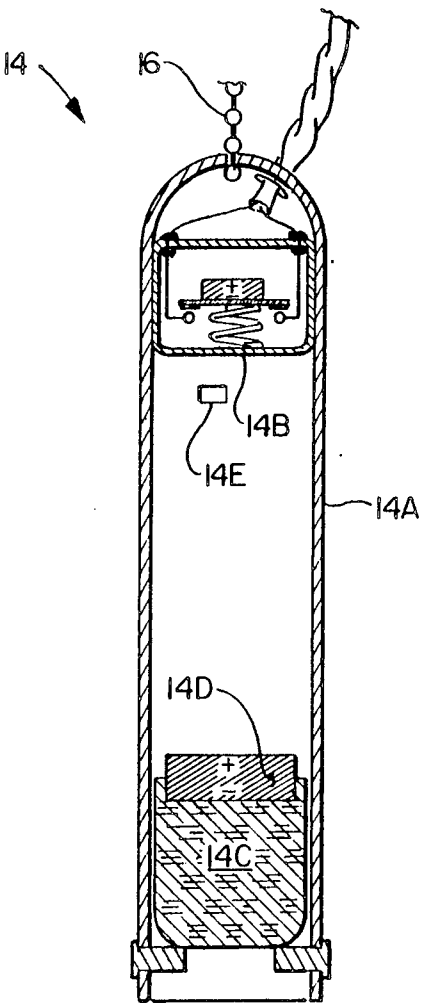

With reference now to FIG. 2 and FIGS. 3A, 3B, applicant will describe the specific features of magnetic float switch 14. Magnetic float switch 14 comprises a protective outer cylindrical cover 14A which is closed at the upper end and open at the lower end thereof. A suitable normally open magnetically actuated electrical switch 14B is positioned in the upper portion of outer cover 14A, and a suitable float member 14C is vertically movably positioned in the bottom portion of outer cover 14A. A magnet 14D is affixed to the top of float member 14C, and one or more apertures 14E are provided in the outer cover of magnetic float switch 14.

Thus, once magnetic float switch 14 has been positioned at a suitable depth in the upper portion of drain conduit DC and secured in that position by flexible chain 16, electrical switch 14B will remain in its normally open position until the water level begins to rise in drain conduit DC (see FIG. 3A). As the water level rises over float switch 14 due to a blockage in the drain conduit or sewage line downstream thereof, float member 14C will rise upwardly within outer cover 14A so as to urge magnet 14D into proximity to electrical switch 14B (see FIG. 3B). Once float member 14C has risen upwardly within outer cover 14A due to the back-up waste water rising over switch 14, magnet 14D will cause normally open electrical switch 14B to close and thereby actuate the circuitry contained within enclosure 12 (and described in more detail below) and interrupt electrical power flow from electrical outlet O through electrical cord C to automatic washing machine W. One or more apertures 14E are provided in the space between float member 14C and electrical switch 14B in order to allow air captured therebetween to escape as float member 14C rises within outer cover 14A of the magnetic float switch.

As can be particularly appreciated with reference to FIGS. 3A and 3B of the drawings, magnetic float switch 14 is uniquely constructed so that float member 14C may rise therein so as to close normally open electrical switch 14B even as waste water flows thereover from drain hose H. This is important since if the magnetic float switch were not properly shielded from waste water flow from drain hose H, the switch would not properly function to actuate the electrical disconnect circuit of overflow prevention device 10 and waste water would back up and spill out of drain conduit DC. Thus, the unique size and configuration of magnetic float switch 14 allows it to be properly positioned down within drain conduit DC and to properly function (even with waste water flowing thereover) to electrically disconnect washing machine W when conduit DC becomes clogged.

Figure 4:
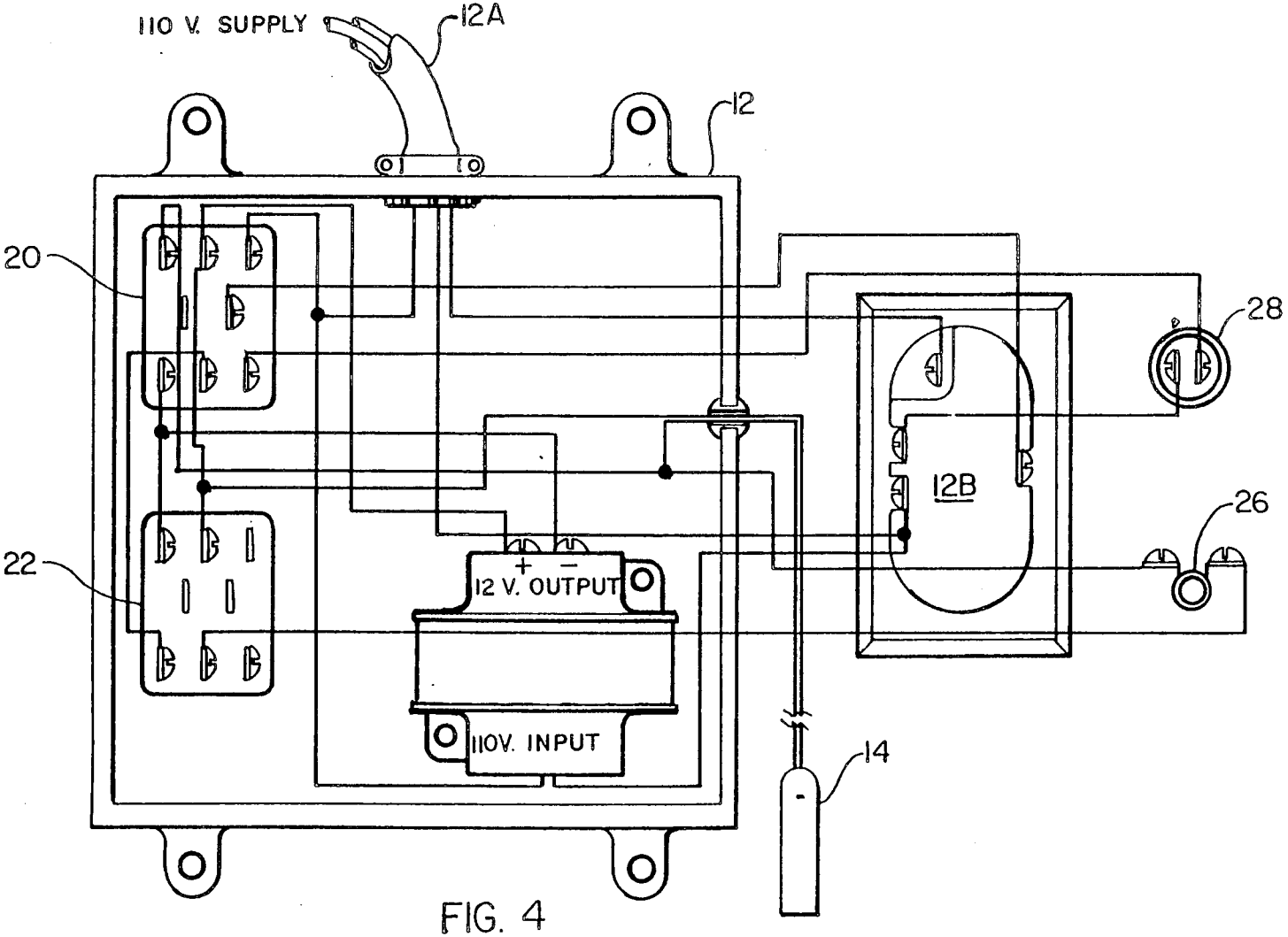
FIG. 4 is a circuit diagram of a preferred circuit for use with the present invention.

With reference now to FIG. 4 of the drawings, a preferred embodiment of the circuitry of overflow prevention device 10 is shown, although applicant wishes to emphasize that the electrical circuitry may be implemented in other configurations and that the specific schematic diagram is not intended to limit the scope of the invention described and claimed herein. The circuit of FIG. 4 includes two 24 volt relays 20, 22 (STEVECO Model 90-340 RBM), one 24 volt transformer 24 (HONEYWELL Model AT 720 1683), normally closed momentary switch 26, 110 volt indicator light 28, electrical plug 12A and electrical outlet 12B, in electrical connection with magnetic float switch 14. In normal operation, float switch 14 is open and 110 volt power flows from plug 12A through relay 20 to electrical outlet 12B into which washing machine W is plugged. The 110 volt power from plug 12A to relay 20 to indicator light 28 is normally interrupted by relay 20. Relay 20 and relay 22 both receive 12 volts of power from the common side of 24 volt transformer 24, and the other 12 volt non-common side of 24 volt transformer 24 provides power to one side of float switch 14, to one side of a normally open switch of relay 20, and to a normally open switch of relay 22. The open side of the aforementioned normally open switch of relay 20 is connected to the coil of relay 22, and the open side of the aforementioned normally open switch of relay 22 is connected to the normally closed momentary switch 26 and therefrom back to the non-common side of the coil of relay 20. The open side of float switch 14 also is connected to the non-common side of the coil of relay 20.

When waste water backs up in drain conduit C, float member 14C raises magnet 14D which serves to close electrical switch 14B and send 12 volts of power to the coil of relay 20. The coil of relay 20 is now actuated and opens the normally closed switch providing 110 volts of power to outlet 12B and closes the normally open switch providing 110 volts of power to indicator light 28 so as to illuminate the light. Also, the normally open switch of relay 20 providing 12 volts to the coil of relay 22 is closed so as to actuate the coil of relay 22 and close the normally open relay switch connected to momentary switch 26. Thus, 12 volts of power are provided through momentary switch 26 and back to the coil of relay 20 so as to provide a continuous 12 volt loop to relay switch 20 and relay switch 22 which prevents the 110 volt power from being provided to electrical outlet 12B. Even if the waste water level now recedes, the 12 volt power loop remains continuous until momentary switch 26 is actuated to open the circuit and allow relay switches 20 and 22 to return to their normal states. If the water level should not recede, the 12 volt loop circuit will continue indefinitely, and actuation of momentary switch 26 will not serve to break the loop circuit. Once the 12 volt loop circuit is broken, indicator light 28 will go off and thereby indicate that power to electrical outlet 12B has been reinstated.

It will be understood that various details of the invention may be changed without departing from the scope of the invention. Furthermore, the foregoing description is for the purpose of illustration only, and not for the purpose of limitation—the invention being defined by the claims.

What is claimed is:

1. In combination a washing machine powered from an electrical outlet and adapted to receive water from a water supply at predetermined intervals in a washing cycle and to remove said water through a drain hose at predetermined intervals in the washing cycle, and an overflow control system comprising:

a drain conduit positioned in a recessed wall plate and adapted to receive said drain hose in the top portion thereof;

float switch means removably positioned below said drain hose and within the top portion of said drain conduit and adapted to be actuated from a normally open to a closed mode when the water level backs up to a predetermined level in the top portion of said drain conduit, said float switch means comprising an elongated protective cover thereover defining a first closed end positioned proximal to the top of said drain conduit and a second open end positioned distally to the top of said drain conduit; and circuit means electrically connected to said float switch means and interposed between said washing machine and said electrical outlet for interrupting electrical power flow to said washing machine upon actuation of said float switch means from the normally open to the closed mode.

2. A washing machine according to claim 1 wherein said float switch means comprises a magnetic float switch.

3. A washing machine according to claim 2 wherein said magnetic float switch comprises a float member positioned proximate to the second open end of said protective cover and an operatively associated electrical switch positioned proximate to the first closed end of said protective cover.

4. A washing machine according to claim 1 including attachment means for removably securing said float switch means at a predetermined location within the top portion of said drain conduits.

5. In combination a washing machine powered from an electrical outlet and adapted to receive water from a water supply at predetermined intervals in a washing machine cycle and to remove said water through a drain hose at predetermined intervals in the washing cycle, and an overflow control system comprising:

a drain conduit positioned in a recessed wall plate and adapted to receive said drain hose in the top portion thereof;

a magnetic float switch removably positioned below said drain hose and within the top portion of said drain conduit and adapted to be actuated from a normally open to a closed mode when the water level backs up to a predetermined level in the top potion of said drain conduit, said float switch comprising an elongated protective cover thereover defining a first closed end positioned proximal to the top of said drain conduit and a second pen end positioned distally to the top of said drain conduit;

circuit means electrically connected to said float switch means and interposed between said washing machine and said electrical outlet for interrupting electrical power flow to said washing machine upon actuation of said float switch means from the normally open to the closed mode; and attachment means removably securing said float switch at a predetermined location within the top portion of said drain conduit.

6. A washing machine according to claim 5 wherein said magnetic float switch comprises a float member positioned proximate to the second open end of said protective cover and an operatively associated electrical switch positioned proximate to the first closed end of said protective cover.

7. A washing machine according to claim 5 wherein said attachment means comprises a flexible chain having one end affixed to said float switch and having a hook member affixed to the other end thereof for attachment to the top of said drain conduit.

* * * * *